US005518371A

United States Patent [19]

Wellstein et al.

[11] Patent Number: 5,518,371

[45] Date of Patent: May 21, 1996

[54] AUTOMATIC FLUID PRESSURE MAINTAINING SYSTEM FROM A WELL

[75] Inventors: Steffen R. Wellstein, Perrysburg, Ohio; Henry R. Burgess; William S. Jack, both of Saline, Mich.

[73] Assignee: Wells, Inc., Risingsun, Ohio

[21] Appl. No.: 262,657

[22] Filed: Jun. 20, 1994

[51] Int. Cl.[6] ..... F04B 49/06

[52] U.S. Cl. ..... 417/44.9; 417/38

[58] Field of Search ..... 417/38, 44.2, 44.9; 200/84 B; 307/118; 361/178

[56] References Cited

U.S. PATENT DOCUMENTS

| | | | |
|---|---|---|---|
| 1,818,132 | 8/1931 | Held | 200/84 B |
| 3,370,544 | 2/1968 | Thorpe, Sr. | 103/223 |
| 3,466,978 | 9/1969 | Carlstedt | 92/95 |
| 3,702,742 | 11/1972 | Russell | 417/25 |
| 3,814,877 | 6/1974 | Alvarez | 200/83 N |
| 4,081,621 | 3/1978 | Hartley | 417/38 |
| 4,160,139 | 7/1979 | Johnston | 200/83 S |
| 4,370,098 | 1/1983 | McClain et al. | 417/18 |
| 4,394,862 | 7/1983 | Shim | 604/67 |
| 4,462,758 | 7/1984 | Speed | 417/38 |
| 4,600,844 | 7/1986 | Atkins | 361/178 |
| 4,664,185 | 5/1987 | Barnard | 417/38 |
| 4,718,824 | 1/1988 | Cholet et al. | 417/14 |
| 4,965,415 | 10/1990 | Young et al. | 200/83 N |

*Primary Examiner*—Richard A. Bertsch
*Assistant Examiner*—Xuan M. Thai
*Attorney, Agent, or Firm*—Hugh Adam Kirk

[57] ABSTRACT

A fluid pressure system comprising an electric motor-driven pump for maintaining a predetermined pressure range in a system, including a remote solid-state encapsulated triac motor control circuit having a micro pressure sensor switch in the outlet duct from the pump. For example, this control device includes a special nipple for installation in a water well casing for maintaining a given range of water pressure in a system supplied by the well.

16 Claims, 3 Drawing Sheets

AUTOMATIC FLUID PRESSURE MAINTAINING SYSTEM FROM A WELL

BACKGROUND OF THE INVENTION

Previously, automatic pressure sensors comprising movable parts for maintaining a predetermined pressure range in a fluid system are well known. However, such systems have arcing electric switches and/or require servicing after a few years. Furthermore, their access for repair is often quite restricted.

SUMMARY OF THE INVENTION

Generally speaking, this invention comprises a micro pressure sensor and solid-state triac control circuit in an electric power line for energizing an electric motor-driven pump. A pressurized duct system is connected to the outlet of the pump so that when the pressure in the outlet duct falls below a predetermined amount, the motor is started to increase the pressure and the motor is shut off when the pressure obtains a predetermined maximum. This control device is particularly adapted for water wells in which the pump is submersed in the well and the sensor for pressure is in the pump's outlet duct often placed inside the well casing remote from most of the pressure system. Since this control device is relatively compact and has substantially no moving parts, it can be and is encapsulated in a resin so as to seal it hermetically from any and all corrosive action. Thus, the device can be placed remote from the usable part of the duct system, since it is relatively maintenance free.

More specifically, the solid-state pressure sensor comprises a micro switch with a stainless steel diaphragm which is connected through a small aperture to the fluid in the outlet duct from the pump. When this diaphragm flexes about 1/30,000 of an inch, it operates a snap action switch in one solid-state triac circuit. This first triac circuit includes a light-sensitive isolator as a connection to a second triac electric AC power supply circuit for the motor of the pump. A built-in heat sink for the high energy portion of this second triac circuit is included in the sensor device upon which the solid-state triac circuit is mounted, thereby preventing overheating of the circuit during the time that the power is supplied to the electric motor. This whole pressure sensor device and its two triac circuits is encapsulated in a resin to hermetically seal all of the electronics and solid-state circuitry from atmosphere and fluid in the system. This device also is provided in a prefabricated nipple section for the outlet duct from the pump, which nipple section includes the heat sink and a duct of substantially equal cross-section to that of the outlet duct, thus preventing any restriction in flow from the pump. Since this second triac circuit can conduct basic high-energy amperage and up to 230 volts, the power circuit to the motor or the pump is also connected to this encapsulated solid-state sensor.

Although a primary use of this particular circuit is for water wells for residents in rural districts, it also may be used for fluid systems for trailer camps, modular houses, or other fields for automatically maintaining at least a minimum pressure in a closed duct system, including a reservoir or vessel.

OBJECTS AND ADVANTAGES

It is an object of this invention to produce a simple, efficient, compact, economic, effective, and relatively permanent device for maintaining pressure in a fluid duct system.

Another object is to produce a solid-state pressure sensor which does not spark, erode or corrode, and does not need repair or replacing within three years of installation.

A further object is to produce such a pressure sensor and solid-state control circuit which is hermetically sealed and can fit into a well casing remote from the usable part of a fluid pressure system.

BRIEF DESCRIPTION OF THE VIEWS

The above mentioned and other features, objects and advantages, and a manner of attaining them will become more apparent and the invention itself will be understood best by reference to the following description of an embodiment of this invention shown taken in conjunction with the accompanying drawings, wherein:

FIG. 1 is a vertical section through a well with parts broken away;

FIG. 2 is an enlarged cross-section taken along line II—II of FIG. 1 through a control device of this invention; FIG. 3 is a sectional view taken along line III—III of FIG. 2; FIG. 4 is a perspective exploded view of FIG. 3; and FIG. 5 is a wiring diagram of the two triac circuits employed on the solid-state panel shown in FIGS. 2, 3, and 4.

DETAILED DESCRIPTION OF PREFERRED EMBODIMENT

Figure 1:
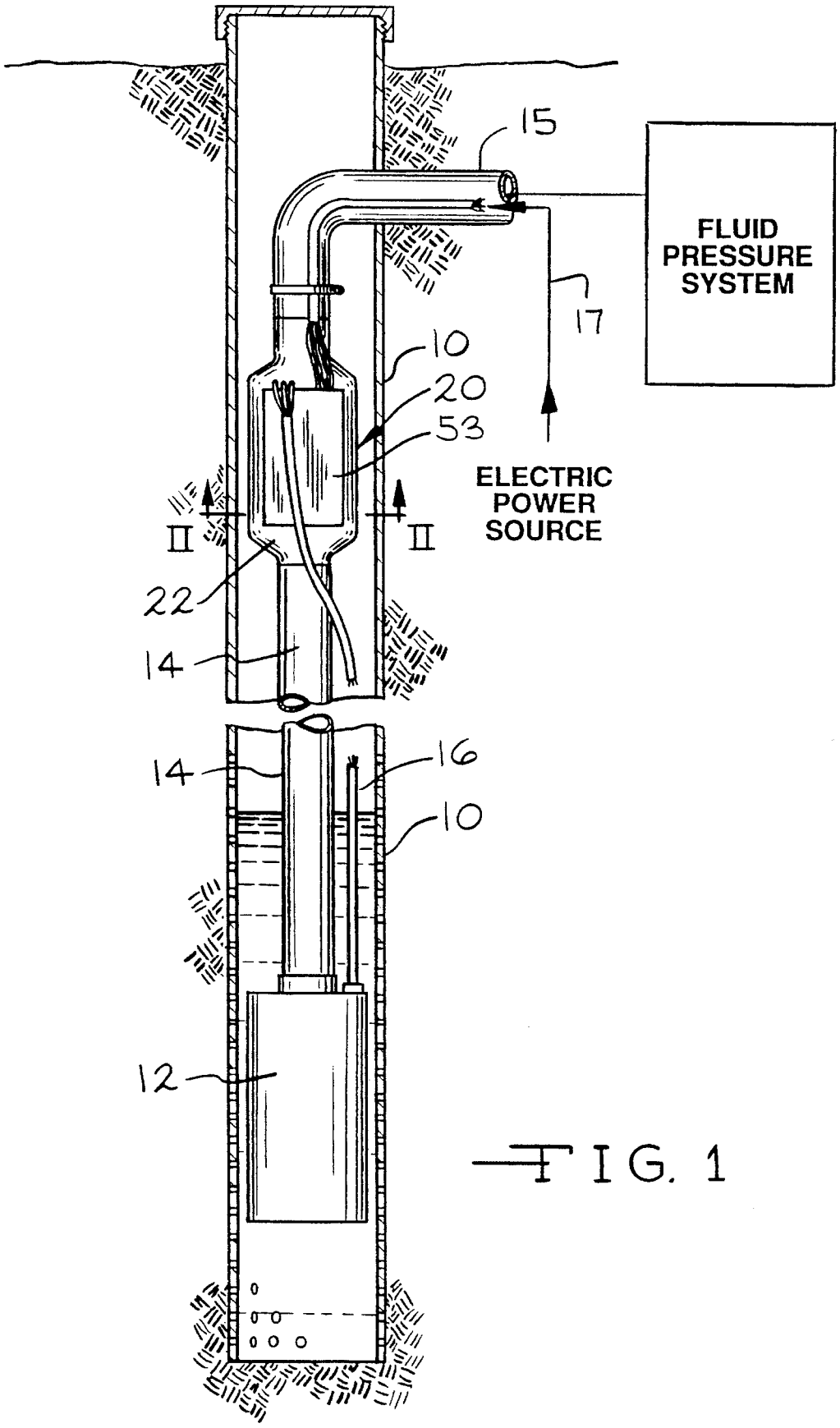

Referring first to FIG. 1, there is shown one example for the use of an automatic fluid pressure maintaining system of the invention adapted for a water well, the upper and lower ends of which well are shown in vertical section. In the lower well casing 10 is a submersible electric motor-driven pump 12 suspended on an outlet duct or pipe 14 and connected to an electric power cable 16. In the upper end of the well casing 10 there is shown a pressure sensor and control device 20 on a nipple section 22 out of the outlet duct 14, 15. This nipple section 22, including device 20, is placed inside the well casing 10 and below the side outlet duct 15 and electric power cable 17. The side duct 15 connects to the fluid system in which a given range of pressures is maintained by the sensor and control device 20 and motor-driven pump 12. The electric power line, cable or conduit 17 is connected to a source of electric power. Neither the rest of the fluid pressure system nor the power source are shown. The power source, however, is probably a standard 230 volt multi-ampere AC power source for adequately powering the electric motor of the motor-driven pump 12. Both the power source cables 16, 17 and the outlet ducts 14,15 are through connected to the pressure sensor and control unit or device 20.

Figure 2:
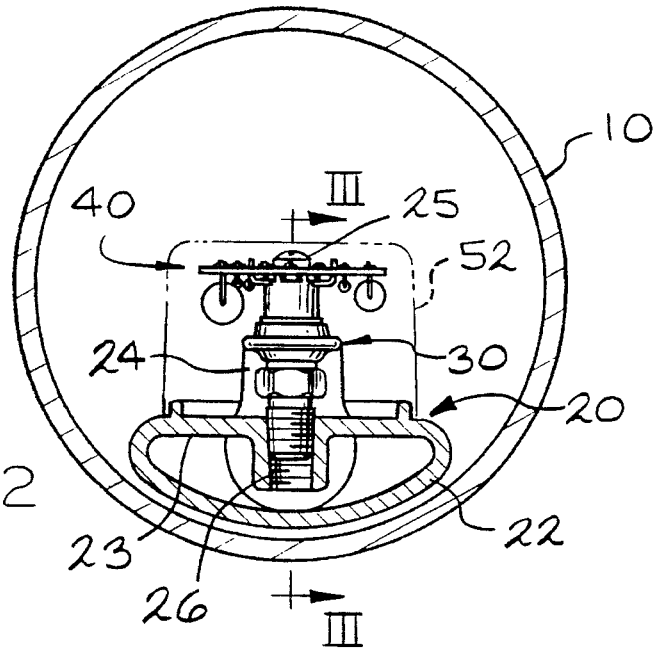
Figure 3:
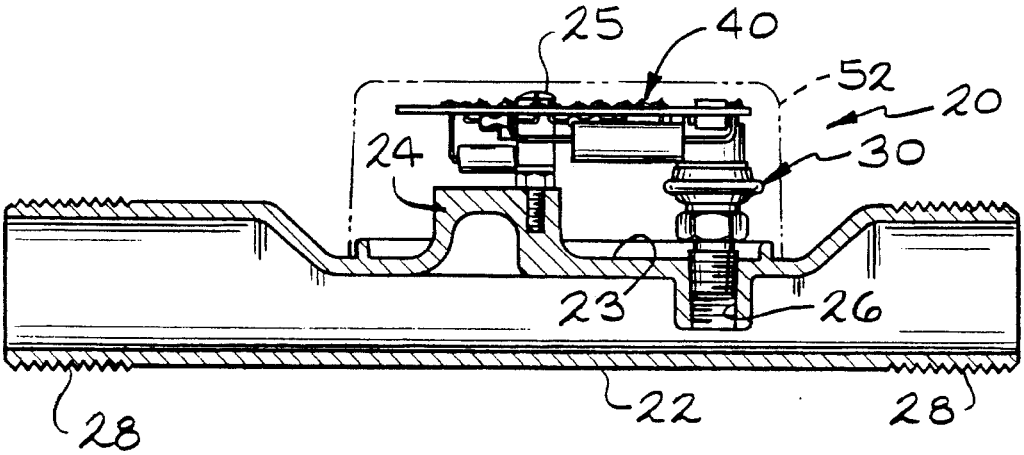
Figure 4:
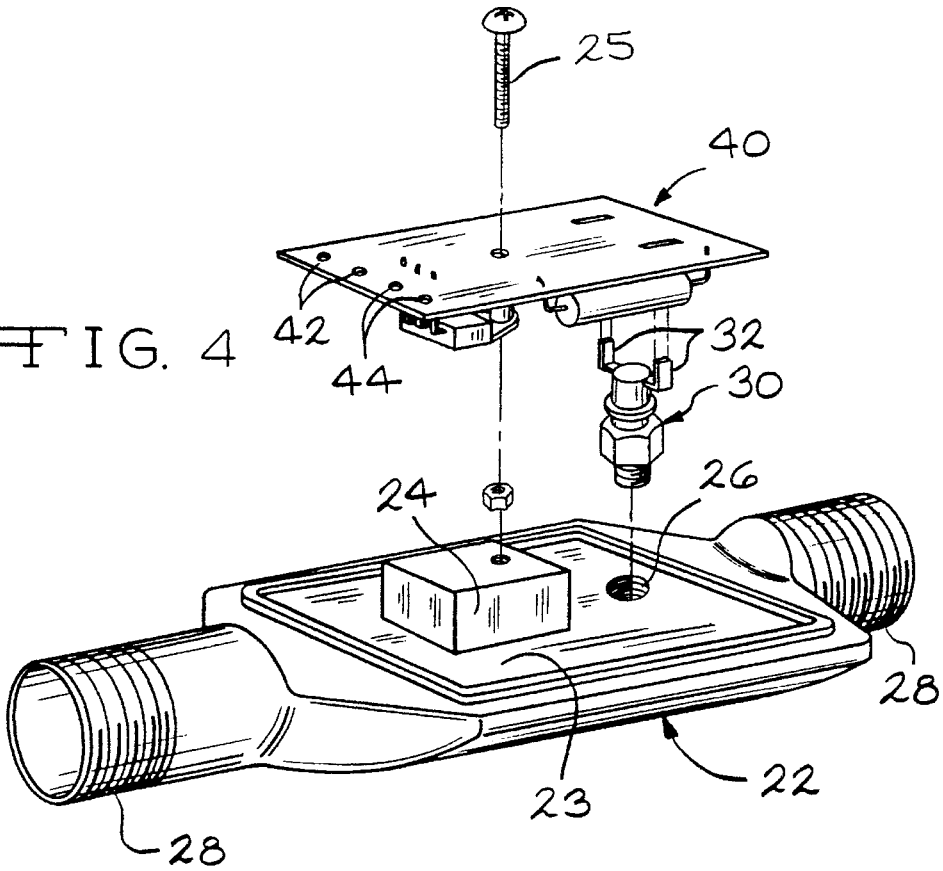

Referring now to FIGS. 2, 3 and 4, there is shown in more detail the pipe nipple 22 with its pressure sensor and solid-state triac control unit 20. This nipple is herein shown to have a flattened circular cross-section configuration for fitting inside and adjacent the cylindrical inner wall of the casing 10. The nipple section 22 is usually of metal, such as cast brass, and has a flattened cord section 23 having an integral heat sink block 24 with a tapped hole for an anchoring screw 25, and a second tapped through hole 26 into which the pressure micro switch 30 is anchored so that its internal micro stainless steel diaphragm can be slightly flexed, i.e. less than about 1/30,000 of an inch, for operating a snap switch 46 in a triac control circuit. This snap switch 46 determines whether the pressure of the fluid in the outlet ducts 15, 17 is adequate. Opposite ends of the nipple casting 22 may be threaded at 28 for fastening to the outlet ducts 14 and 15.

The two upwardly extending terminals 32 on the micro switch 30 are connected to a circuit board 40 which contains on the underside thereof a first low voltage triac circuit. This circuit board 40 is anchored by screw 25 into a tapped hole in the heat sink 24. This heat sink 24 is located to be in engagement with that part of the second power triac circuit which conducts the electric power to the electric motor of the pump. The terminals of this electric power circuit are connected to the terminals 42, 44 at one end of the circuit board or panel 40.

Figure 5:
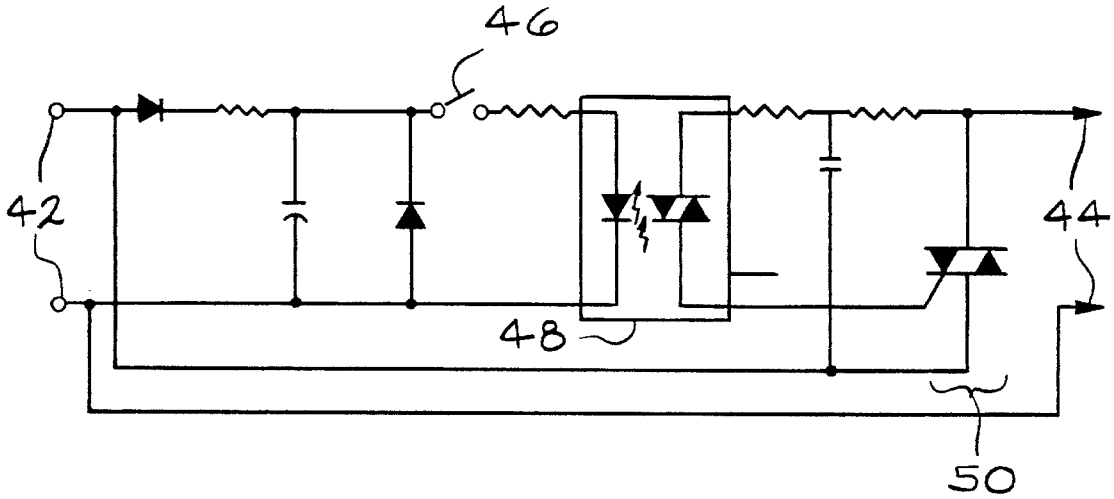

FIG. 5 is a wiring diagram of the two triac circuits on the solid-state circuit board 40 showing the power input terminals 42 and the power output terminals 44 at opposite ends of the circuit diagram. The micro snap switch 46 operated by the small flexing stainless steel diaphragm in the pressure sensor 30 is in the low power triac circuit which is optically connected by a light-emitting diode in panel 48 to the high power triac circuit 50 which is mounted on the heat sink 24. Once these parts are assembled on the nipple 22, they are all encapsulated in a resin as shown by the dotted line 52 in FIGS. 2 and 3.

While there is described above the principles of this invention in connection with specific apparatus, it is to be clearly understood that this description is made only by way of example, and not as a limitation to the scope of this invention.

We claim:

1. In a fluid pressure system having a fluid source, an AC electric motor-driven pump connected to said source, an AC electric power source connected to said motor, an outlet duct from said pump, and a pressure-sensing and switching means connected between said outlet duct and said AC power source for automatically maintaining a predetermined range of pressures in said outlet duct, the improvement comprising:

a) said sensing and switching means comprising a solid-state semiconductor control circuit mounted in a nipple section of said outlet duct, and b) a hermetically-sealing plastic encapsulating said control circuit.

2. A system according to claim 1 wherein said fluid source is a water well.

3. A system according to claim 1 wherein said pressure sensing means comprises a stainless steel diaphragm operating a snap switch.

4. A system according to claim 1 wherein said pressure sensing and switching means are located remote from said fluid pressure system.

5. A system according to claim 1 wherein said pressure sensing and switching means is adjacent said fluid source.

6. A system according to claim 1 wherein said solid-state semiconductor control circuit comprises a low power and a high power triac circuit.

7. A system according to claim 1 wherein said solid-state semiconductor control circuit comprises a diaphragm and snap switch in said pressure sensing means in a low power triac circuit.

8. A system according to claim 1 wherein said solid-state semiconductor control circuit comprises a high power triac in said AC electric power source circuit.

9. A system according to claim 1 wherein said nipple section includes a heat sink for said switching means.

10. A system according to claim 1 wherein said nipple section is formed to fit inside a well casing.

11. In a fluid pressure system having a fluid source, an electric motor-driven pump, an AC electric power circuit connected to said motor, and an outlet duct from said pump in which outlet duct a predetermined range of pressures are to be automatically maintained, the improvement comprising:

1) a solid-state pressure-sensing device in said outlet duct, said device comprising:

a) a pressure-sensor for the fluid in said duct, b) a semiconductor low-voltage control circuit having a switch responsive to said pressure sensor, c) a semiconductor high-voltage control circuit in said AC electric power control circuit, d) a light-sensitive connection between said semiconductor control circuits, and e) a heat sink connected to said semiconductor high-voltage AC power control circuit, and 2) means encapsulating said solid-state sensing device in a hermetically-sealed plastic.

12. A system according to claim 11 wherein said high and low voltage control circuits comprise separate triac circuits.

13. A system according to claim 11 wherein said solid-state pressure sensing device is incorporated in a nipple section in said outlet duct.

14. A system according to claim 13 wherein said nipple section is formed to fit inside of a well casing.

15. In a fluid system comprising an electric motor-driven pump having an outlet duct and an electric AC power circuit for said motor, the improvement comprising a solid-state pressure-sensing device for controlling the motor to maintain a predetermined pressure range in said duct, said device comprising:

a) a non-corrosive pressure-sensing snap-action microswitch in said duct, b) a low-voltage triac control circuit for said microswitch, c) a high-voltage AC triac control circuit for said electric AC power control circuit, d) a light-sensitive diode connector between said triac control circuits, e) a heat sink connected to said high-voltage AC power control circuit, and f) a plastic sealing material potting said triac control circuits.

16. In a system having a liquid source, a duct from said source, an electric motor-driven pump between said source and said duct, a power circuit to energize said electric motor, a pressure sensor in said duct away from said pump and said source for automatically starting said motor-driven pump to build up a predetermined pressure in said duct when said pressure falls below a predetermined amount, the improvement comprising:

a) a nipple section in said duct containing said sensor and having a through duct of substantially the same cross-sectional area, said nipple section having an integral heat sink portion and an aperture into said through duct, b) a corrosion-resistant diaphragm mounted in said aperture and mounting a microswitch, c) two triac solid-state circuits mounted on said heat sink portion and connected to said microswitch and to said power circuit whereby said microswitch controls said triac circuits for controlling said electric motor, and d) a hermetically-sealed plastic encapsulating said triac circuit, said microswitch, said heat sink, and that portion of said power circuit that is connected to said triac circuits.

* * * * *